US009254943B2

(12) United States Patent
Brooks

(10) Patent No.: US 9,254,943 B2
(45) Date of Patent: Feb. 9, 2016

(54) CLOSURE FOR A BOTTLE

(75) Inventor: John Stanley Brooks, Leabrook (AU)

(73) Assignee: Scholle Corporation, Northlake, IL (US)

( * ) Notice: Subject to any disclaimer, the term of this patent is extended or adjusted under 35 U.S.C. 154(b) by 330 days.

(21) Appl. No.: 13/123,315

(22) PCT Filed: Oct. 9, 2009

(86) PCT No.: PCT/AU2009/001339

§ 371 (c)(1), (2), (4) Date: Sep. 6, 2011

(87) PCT Pub. No.: WO2010/040186

PCT Pub. Date: Apr. 15, 2010

(65) Prior Publication Data

US 2011/0303632 A1 Dec. 15, 2011

(30) Foreign Application Priority Data

Oct. 10, 2008 (AU) ..... 2008905271

(51) Int. Cl.

| | |
|---|---|
| ***B65D 39/00*** | (2006.01) |
| ***B65D 49/12*** | (2006.01) |
| ***B65D 41/00*** | (2006.01) |
| ***B65D 41/58*** | (2006.01) |
| ***B65D 41/28*** | (2006.01) |
| ***B65D 41/62*** | (2006.01) |
| ***B65D 45/32*** | (2006.01) |
| ***B65D 51/18*** | (2006.01) |

(52) U.S. Cl.

CPC ..... *B65D 41/58* (2013.01); *B65D 41/28* (2013.01); *B65D 41/62* (2013.01); *B65D 45/322* (2013.01); *B65D 51/18* (2013.01); *B65D 2101/0038* (2013.01); *B65D 2251/0015* (2013.01); *B65D 2251/0075* (2013.01)

(58) Field of Classification Search

CPC ..... B65D 2101/0038; B65D 41/023; B65D 41/58; B65D 55/0818

USPC ..... 215/359, 254, 256, 258, 251, 226, 316, 215/277–280, 295, 318, 321, 320, 327

See application file for complete search history.

(56) References Cited

U.S. PATENT DOCUMENTS 1,798,151 A * 3/1931 Fabrice ..... 215/256
3,245,569 A * 4/1966 Essich ..... 215/329

(Continued)

*Primary Examiner* — Shawn M Braden

(74) *Attorney, Agent, or Firm* — The Watson I.P. Group, PLC; Jovan N. Jovanovic; Vladan M. Vasiljevic

(57) ABSTRACT

A closure (10) for a bottle containing a carbonated beverage. The closure (10) including an inner part (40) and an outer part (5). The inner part (40) adapted to receive a portion of a finish of the bottle. The inner part (40) includes one or more outwardly extending raised portions (52). The outer part (5) is adapted to fit substantially over the inner part (40) and is movable relative to the inner part (40) between a closed position, in which at least a portion of the outer part (5) urges at least a portion of the inner part (40) against the neck of the bottle to resist disengagement of the inner part (40) from the finish and to resist rotational movement of the inner part (40) relative to the finish, and an open position, in which the inner part (40) allows disengagement from the finish. The outer part (5) includes one or more inwardly extending raised portions (17). The outwardly extending raised portions (52) and the inwardly extending raised portions (17) are configured to engage and prevent relative rotation between the inner part (40) and the outer part (5) in the closed position and the open position.

10 Claims, 5 Drawing Sheets

(56) References Cited

U.S. PATENT DOCUMENTS 3,950,917 A * 4/1976 Choksi et al. ..... 53/492
3,995,762 A * 12/1976 Pfefferkorn et al. ..... 215/256
4,081,720 A * 3/1978 Pfefferkorn et al. ..... 215/354
4,303,167 A * 12/1981 Martinez ..... 215/256
6,050,436 A * 4/2000 Bennett et al. ..... 215/256
7,210,592 B1 * 5/2007 Dautreppe et al. ..... 53/412
7,570,161 B2 * 8/2009 Necchi ..... 340/568.1
2009/0020535 A1 * 1/2009 Joubert et al. ..... 220/521

* cited by examiner

CLOSURE FOR A BOTTLE

FIELD OF THE INVENTION

The present invention relates to a closure for a bottle containing carbonated beverages.

The invention has been primarily developed for use with bottles containing sparkling wine and will be described hereinafter with reference to that application. However, it will be appreciated by persons skilled in the art that the invention is not limited to this particular application and is also suitable for use with bottles containing other carbonated beverages including sparkling juices, Champagne, ciders and sparkling water.

DESCRIPTION OF THE PRIOR ART

There are two main types of wine beverages. The first of these is what is commonly referred to as "un-carbonated" or "still". That is the wine does not contain a charge of carbon dioxide ($CO_2$) dissolved in the liquid. The second type of wine is "carbonated" in that dissolved within the liquid is $CO_2$, or some other food grade gas, most common however is $CO_2$. An example of a carbonated wine is sparkling wine, in which $CO_2$ is generated during a secondary fermentation processes, or added prior to, or during, the bottling process.

For either type of wine it is traditional to use a closure made from cork to seal the bottle, although there are a number of alternatives to cork closures including screw-cap closures and synthetic cork replacements. More recently there have been advances in wine closures such as those disclosed in W004058586A 1, which describes a way of sealing a wine bottle containing an un-carbonated wine. Indeed, the wine bottle closure of W004058586A 1 address a number of common problems associated with the use of standard cork closures such as cork taint, as a result of trichloroanisole (TCA) leaching into the wine as well as the general degradation of cork closures that are not kept at the correct conditions.

The most common way in which sparkling wine bottles are closed is with a cork and a retaining wire cage called a "muselet". The wire cage covers the cork and wraps under the collar of the bottle and held in place by a tightening of the wire. In use, the wire cage is first loosened then may be removed from the cork and the cork then either removed with the aid of a cork extractor or grip or gently levered off by hand. Without the wire cage restraining the cork, the pressure generated inside the bottle by the release of $CO_2$ from the wine can result in the rapid ejection of the cork.

Indeed, rapid ejection of sparkling wine corks is responsible for 20% of recorded eye injuries caused by bottles containing pressurized drinks in the United States. A 750 ml bottle of sparkling wine contains approximately 4 litres of $CO_2$ at a pressure of 620 kPa, which can propel a 30 g cork some 13 m. As a result, bottles of sparkling wine in the US now carry labels warning of potential eye injury.

Apart from the potential for eye injury, cork closures on sparkling wine bottles can suffer the same problems as still wine cork closure. This includes the significant problem of cark taint resulting from the TCA leeching from the cork into the sparkling wine and affecting the taste.

In addition, there is the transmission of gas through or past the closure; resulting in loss of $CO_2$ thus the sparkling wine becomes flat. Approximately 5-10% of sparkling wines suffer this fate.

This then becomes an important quality issue for producers of sparkling wine, as the introduction of TCA into the product and loss of bubbles results in un-acceptance of the wine, and in severe cases the spoilage of entire vintages.

Wine bottle closures, such as those of W004058586A 1, do not suffer from cork taint and still provide a way of closing a standard wine bottle having a collar on the finish of the bottle. However, such closures are not suitable as a closure for bottles containing carbonated beverages, as they do not have the mechanical strength to maintain an acceptable hold onto the collar under pressure.

Plastic corks, have been used, however, these types of closures do not solve the safety issue, are associated with inferior product and are not generally accepted.

Screw cap and crown seal closures have also been used to close sparkling wine bottles, but again the problem is that there is an association of such closures with cheaper products such as soft drinks, and as such they have not been widely accepted by the consuming public plus they do not use a standard neck finish such as the single or double band cork mouth finish.

Moreover, when using cork closure there is the problem of how to re-seal the bottle once it has been opened. Most often a specialized stopper is used to securely close the bottle, as the original cork closure is very difficult to reinsert.

OBJECT OF THE INVENTION

It is an object of the present invention to provide an improved closure, particularly in relation to ease and intuitiveness of use, suitable for bottles containing a carbonated beverage.

SUMMARY OF THE INVENTION

Accordingly, in a first aspect, the present invention provides a closure for a bottle containing a carbonated beverage, the closure including:

an inner part adapted to receive a portion of a finish of the bottle, the inner part including one or more outwardly extending raised portions; and an outer part adapted to fit substantially over the inner part and being movable relative to the inner part between a closed position, in which at least a portion of the outer part urges at least a portion of the inner part against the neck of the bottle to resist disengagement of the inner part from the finish and to frictionally resist rotational movement of the inner part relative to the finish, and an open position, in which the inner part allows disengagement from the finish, the outer part including one or more inwardly extending raised portions, wherein the outwardly extending raised portions and the inwardly extending raised portions are configured to engage and prevent relative rotation between the inner part and the outer part in the closed position and the open position.

The inner part preferably includes a first plurality of the outwardly extending raised portions and a second plurality of the outwardly extending raised portions, substantially adjacent the top and the bottom of the inner part respectively.

The inner part raised portions are preferably substantially parallel to the outer part raised portions.

The inner part raised portions and the outer part raised portions preferably extend generally longitudinally.

In one form, the inner part and the outer part preferably include a like plurality of said respective raised portions. In one form, the inner part and the outer part preferably include a different plurality of said respective raised portions.

The closure preferably includes an outer surround having a first end connected to the outer part and a second end releasably connected to the neck of the bottle, whereby the connection between the surround and the bottle must be released to allow the outer member to move from the closed position to the open position. The releasing force is preferably substantially circular or spiral in direction and, when in the closed position, the engagement of the inner portion raised portions and the outer portion raised portions prevents torque transmitted to the outer part by the releasing force from rotating the closure relative to the bottle.

The surround is preferably a tear strip, most preferably manually tearable. The tear strip is preferably spirally wound around the neck of the bottle.

In a second aspect, the present invention provides a bottle closure, the closure having:

(a) a first part and (b) a second part, (c) first part has a plurality of raised portions positioned about an inner circumference of an inner cavity, the raised portions being spaced apart and substantially parallel with one another, (d) the second part has at least one row of raised portions positioned about an other periphery and spaced apart from each other, (e) so that when in use, the second part is inserted into the first part that the raised portions of the first and second parts engage with one another to substantially prevent any rotational movement of the first and second portions relative to one another.

In preference, the second part has a second row of raised portions positioned about its periphery, the second row being substantially parallel to the at least one row.

In preference, the raised portions extend longitudinally.

In preference, the inner cavity of the first part has a flange about the inner circumference, substantially perpendicular to the raised portions.

In preference, the second part has a plunger.

In preference, the bottle is a wine bottle.

In preference, the bottle is a sparkling wine bottle.

In preference, the bottle has a collar located around the neck as part the neck finish.

In preference, the first part has an integral lower surround section that engages the collar of the neck finish to provide a resilient force to removal of the closure from the bottle once applied thereto.

In this way the integral lower surround assists in keeping the closure on the bottle.

In preference, the lower surround is a tear away strip.

In preference the tear away strip is a tamper evident seal.

In preference, the closure having a first part and a second part, the first part having a portion adapted to receive a portion of an upper section of a neck of the bottle, and a second part that fits substantially over the first part, which is relatively movable with respect to the first part and has at least two positions, a first of which is in a free (open) position and a second of which is in an interlocking (closed) position whereby a portion of the second part urges against a portion of the first part receiving the upper section of the neck of the bottle so as to be engaging against an outer side of the said first part to hold it thereby to resist release from its interlocking position with respect to the said neck of an industry standard bottle.

In preference, the first part includes a body having an outer surround that snaps onto and engages with an interlocking fit an outwardly extending integral collar on a neck of the bottle.

In preference, the first part has a section of an outermost periphery shaped to engage with an inner portion of the second part.

In preference, the second part includes a cap adapted to fit over at least a substantial portion of the body of the first part, the cap engaging with the outer surround in a first holding position so as to provide a compression force against an outer surface of the outer surround to effect a tightening of the outer surround to the bottle.

In preference, there is at least a first seal to be held under compression against the uppermost rim of the bottle mouth.

In preference, the second part further includes a lower surround section.

In preference, the outer surround further includes an upper surround section and a lower surround section.

In preference, the lower surround section extends over the integral collar on the neck of the bottle.

In preference, the lower surround section has an inwardly directed lip that affects the interlocking fit with a lower edge of the integral collar of the bottle.

In preference, the lower surround section is joined to the upper surround section by a weakened zone.

In preference, the lower surround section is a tear away strip.

In preference, the lower surround section is integral with the upper surround and engages the collar of the neck finish to provide a resilient force to removal of the closure from the bottle once applied thereto.

In preference, the upper surround section has an inwardly directed lip that affects an interlocking fit with a lower edge of an integral bead on the mouth of the bottle.

In preference, the upper surround section has at least a first groove on its outer surface shaped to engage a bead positioned on an inner surface of the cap.

In preference, the upper surround section has a second groove on its outer surface shaped to engage with a bead positioned on an inner surface the cap, the second groove being located above the first groove to provide a second holding position.

In preference, the second groove is located on the body.

In preference, when in the second holding position the cap no longer provides a compression force against the outer surface of the outer surround.

Thus the cap has at least two positions, the first being a free or open position that does not provide any compression force against the first part (the outer surround) and the second position being the closed or interlocking position in which the cap does apply a force to the first part such that it interlocks with the bottle.

In preference, there is a second seal located between the first seal and the body.

In preference, the first seal has a central portion that extends substantially into the mouth of the bottle.

In preference, the central portion has at least one longitudinal groove extending along a direction of elongation of the central portion so as to allow fluid communication (venting of pressurised gas) between the inside of the bottle and the outside of the bottle during extraction of the central portion from the neck of the bottle.

In preference, the at least one longitudinal groove has a first end and a second end, the first end terminating at least substantially midway along the direction of elongation of the central portion.

BRIEF DESCRIPTION OF THE DRAWINGS

A preferred embodiment of the invention will now be described, by way of examples only, with reference to the accompanying drawings in which.

DETAILED DESCRIPTION OF THE INVENTION

By way of further background, the design of bottles for carbonated beverages such as sparkling wine or Champagne, is relatively standardised and includes: a lower end known as a punt; a substantially cylindrical, relatively wide portion adjacent the punt known as a label panel; an upwardly, inwardly tapering part extending from the label panel known as a neck; and a part known as a finish from the top of the neck to the top of the bottle. The finish includes a wire or muselet bead on its lower end and a crown bead on its upper end. The bottle opening adjacent the crown bead is known as the mouth which communicates with the internal cavity of the bottle via a bore. The wire or muselet bead is often referred to as a CETIE (Centre Technique International de l'Embouteillage et du Conditionnement) band.

Figure 1:
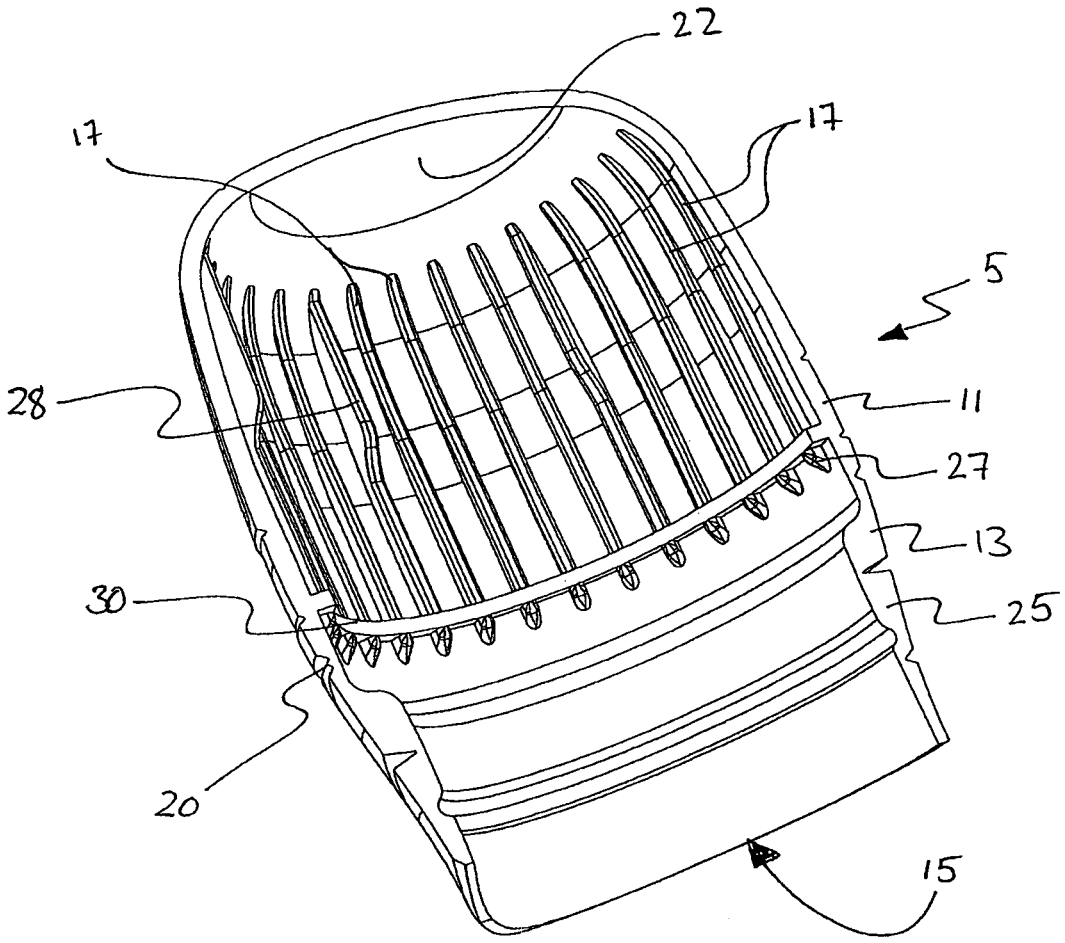
FIG. 1 is a cut away perspective view of the first part of the closure.
Figure 2:
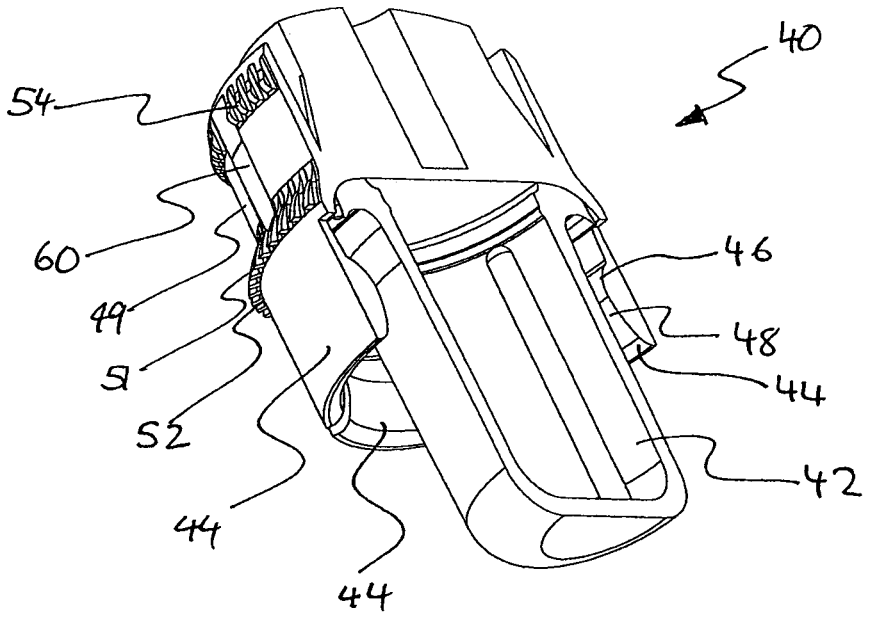
FIG. 2 is a cut away perspective view of the second part of the closure.

FIG. 1 shows a cut away perspective view of a first (outer) part 5 of an embodiment of a closure 10 for a bottle of sparkling wine. The first part 5 has a body 11 and a skirt 13. The skirt 13 is adapted to engage with the neck of the sparkling wine bottle.

The first part 5 has an inner cavity 15 with a plurality of inwardly directed raised portions or projections 17, which are positioned parallel to one another about an inner circumference. The projections 17 travel along the length of the cavity 15 from above a weakened section 20, which defines the intersection of a (manually removable) tear strip and tamper proof seal 25, to an end 22 of the cavity 15.

Each projection 17 has a ramp section 27 at a first end and selected projections 18 have an additional raised shoulder 28. Positioned substantially perpendicular to the projections 17 is a flange 30 that located close to the ramp sections 27.

Figure 5:
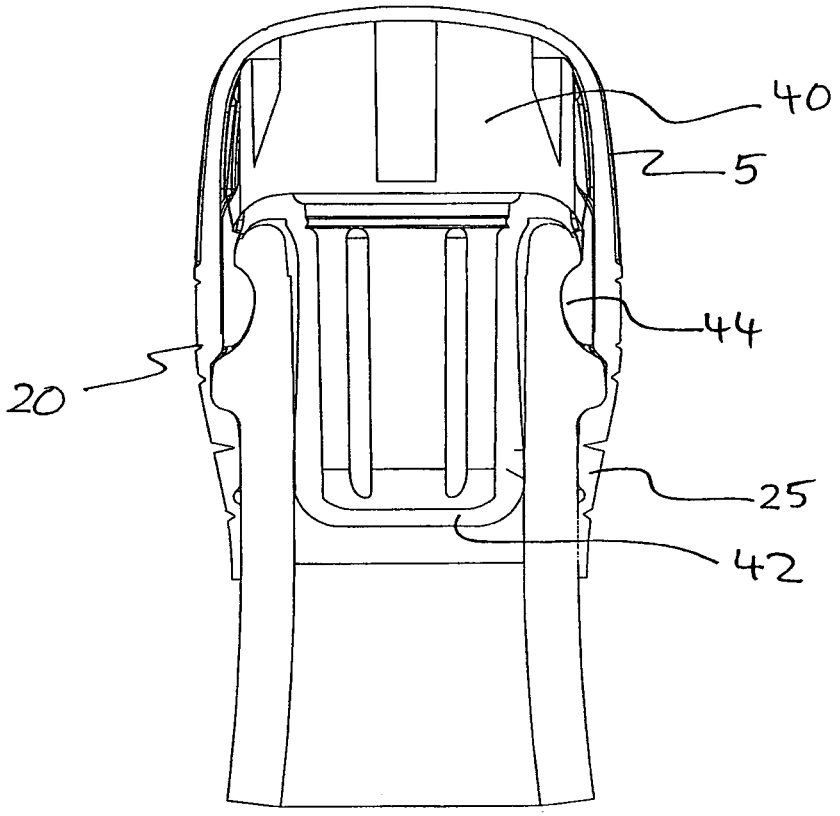
FIG. 5 is a side sectional view of the invention in a closed position on a sparkling wine bottle.

The closure 10 also includes a second (inner) part 40 that has a plunger 42 that can fit within the mouth of the bottle, and flexible segments 44 having an inner shape 46 adapted to engage a finish of the bottle, as shown in FIG. 5. In another embodiment (not shown), the length of the plunger is minimised (eg. 5-25 mm in length).

Located about the bottom or outer periphery 49 of the second part 40 is a row 51 of a first plurality of outwardly directed raised portions 52, each having a shoulder or ramp. The raised portions 52 are parallel to one another and are sufficiently spaced apart to allow the projections 17 on the first part 5 to sit within them (ie. nest).

There is a further row of a second plurality (equal in number to the first plurality) of inwardly directed raised portions 54 located about the top or upper periphery of the second part 40, again each portion having a shoulder or ramp section thereon.

In this way, when the second part 40 is inserted into the cavity 15 of the first part 5, the ramped or sloped sections on the raised portions 52 urge up against the flange 30, forcing the body 11 to slightly expand up and over the portions 52. At this point the projections 17 then align themselves with the spaces between the raised portions 52, thus ensuring that the first part 5 and the second part 40 nest within one another.

The projections 54 also engage the upper section of the raised projections 17 and the raised shoulders 28 nest within the channels 60. These provide additional structural support to the closure 10 and ensure rigidity of the first part 5.

Figure 3:
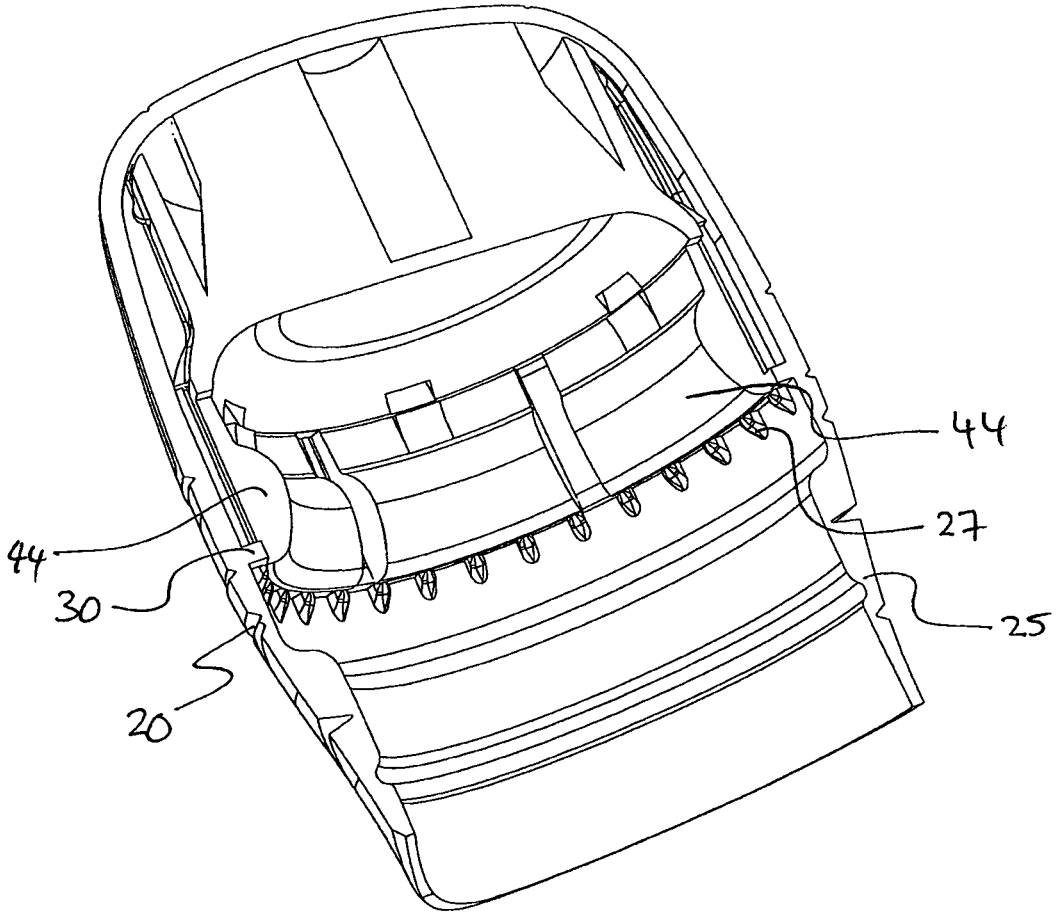
FIG. 3 is a cut away perspective view of the second part engaged with the first part in a closed position, the plunger is not shown for clarity.
Figure 4:
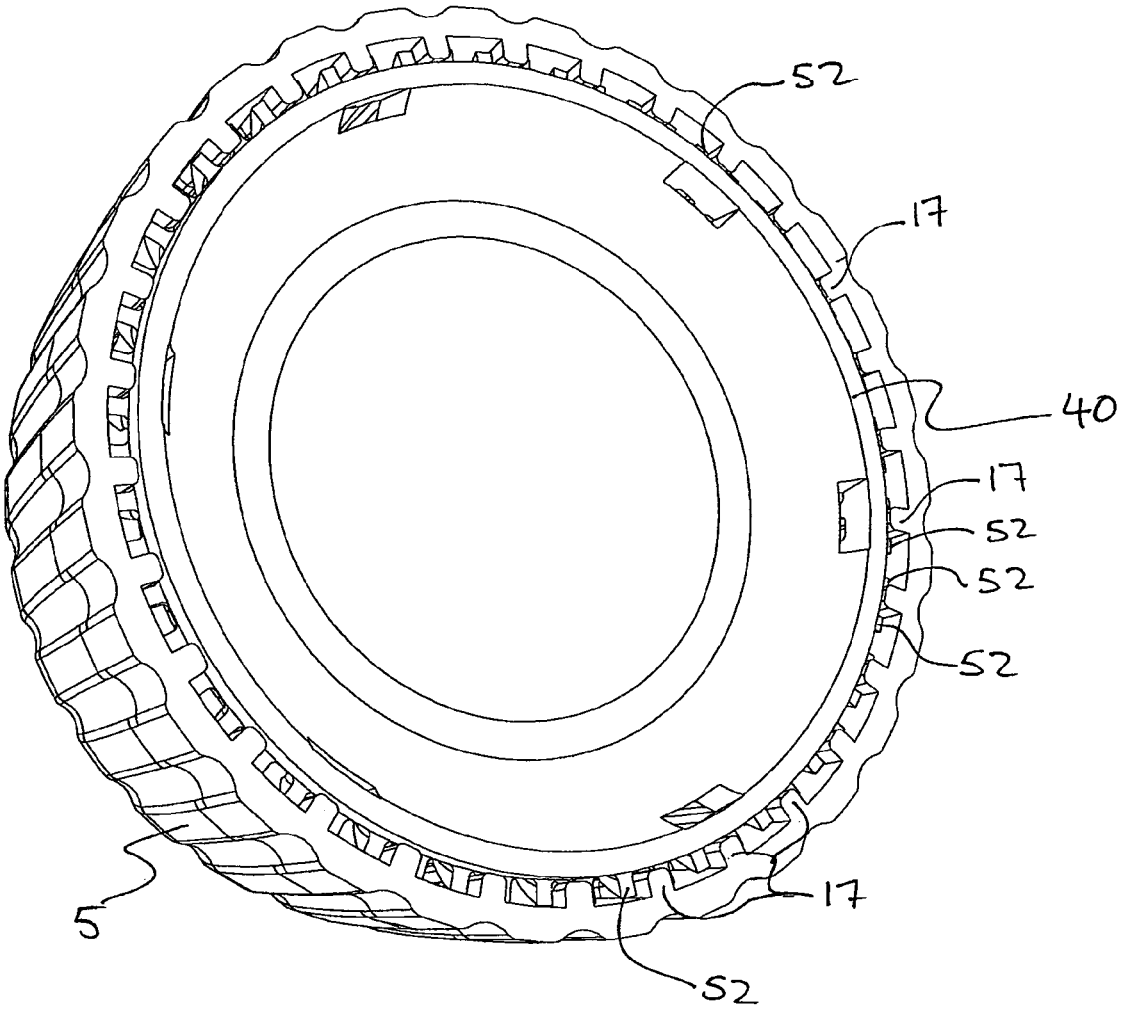
FIG. 4 is a cut away sectional view of FIG. 3 showing the first and second parts in a closed (ie. engaged or interlocking) position.

The nesting fit of the first part 5 and second part 40 can be seen in FIG. 3. The first part 5 restricting the outward expansion of the segments 44 of the second part 40. This is referred to a closed position and causes the closure 10 to be held securely in place on the bottle. More particularly, the segments 44 are urged into engagement with the neck of the bottle. To remove the closure 10, the tamper proof seal 25 is removed and the first part 5 is then moved upwardly relative to the second part 40 and the bottle until reaches what is referred to as an open position, in which the segments 44 are able to expand outwardly and release their grip on (i.e. engagement with) the neck of the bottle. The closure 10 can then be removed from the bottle.

Importantly, what is now apparent is that the engagement of the raised projections 17 on the first part 5 and the raised portions 52 on the second part 40 restrict the rotational movement of each of the first part 5 and the second part 40 with respect to one another. Accordingly, a user removing the closure 10 will be able to apply a torque to, and twist, the first part 5 and this will result in rotational movement of the second part 5 as they will be moving substantially together due to the nesting arrangement of the projections 17 and the raised portions 52.

More particularly, bottles of carbonated beverages, such as sparkling wine with a cork closure, are traditionally opened by either of two methods. The first method involves applying a longitudinally directed force to the cork, sometimes accompanied by a slight side-to-side rocking motion. This method is often used to pop and propel a cork from a bottle. The second method is to, when viewed from above and towards the top of a bottle, twist the cork in a counter-clockwise direction relative to the bottle. This method is often used to provide a gentler opening of the bottle, retaining the cork and minimising gas loss. Advantageously, after the tamper proof seal 25 has been removed and the first part 5 placed in the open position, the closure 10 can be removed by either of these methods. In the second (twisting) opening method, a user can twist and apply torque to the first part 5 and have that torque transmitted to the second part 40 in order to assist in removing the plunger 42 from engagement with the mouth of the bottle. This results in the closure 10 being easy, and importantly intuitive, for a user and provides a significant advantage in terms of customer acceptance of the closure 10, which is, of course, an alternative to the well known cork closure.

Further, and as mentioned previously, the seal 25 must first be removed before the first part 5 can be moved from the closed position to the open position. The seal 25 therefore provides tamper evidence of the bottle not being opened. The seal 25 also increases the longitidinal strength and the hoop strength of the closure 10. The seal 25 securely engages the bottle under the CETIE band and provides an additional level of sealing security, sufficient to withstand the initial (relatively high) pressurisation of the bottle. The seal 25 is arranged so as to be peeled off (unwound) in a circular or spiral direction and a torque is applied to the seal 25 during this process. The second part 40 is frictionally engaged with the bottle and is nestingly engaged with the first part 5, via the projections 17 and the portions 54. Importantly, this prevents the closure 10 from rotating relative to the bottle when torque is applied the seal 25 to release same. The release of the seal 25 is also advantageously somewhat akin to the removal of the muselet or wire cage that must be performed before removing corks from sparkling wine bottles, again aiding user familiarity and acceptance. It is also important to note that the seal 25 is removed completely from the bottle 20, thereby avoiding an association with products such as soft drinks which often have some type of tamper indicating device retained on the neck of the bottle after removal of, for example, a screw cap closure.

If a user wishes to reseal the bottle, the closure 10 is merely applied to the mouth of the bottle and downward pressure applied to the first part 5. This is advantageously also how a cork or other stopper would be reapplied. As will be understood, this allows an untrained user to intuitively open the closure 10 and also reseal the closure 10 without requiring any specific instruction or training. The closure 10 in the closed position is suitable for resealing a bottle of carbonated beverage, after the initial release of pressure that occurs during the initial opening.

The closure 10 is applied to the bottle using conventional bottling equipment as the polyethylene material is sufficiently flexible to be forced over the finish and CETIE band without damage, and resilient enough to return to a snug fit on the finish. In particular, the seal 25 contains spirally directed lines of weakness 20 that will rupture during manual unpeeling removal, but do not rupture during application to the bottle.

On fitting the closure to a bottle, the tamper proof seal 25 is forced over the bottle mouth and thus over the bottle finish. In this way the tamper proof seal 25 engages with the bottle neck, as seen in FIG. 5 and assists in retaining the closure on the bottle.

The lower portion of the tamper proof seal 25 is greatly tapered towards its end, providing only a very small edge that is substantially flush with the neck finish so as to reduce the likelihood of the closure 10 being able to be levered off.

Although the invention has been described with reference to preferred embodiments, it will be appreciated by persons skilled in the art that the invention may be embodied in many other forms.

The invention claimed is:

1. A closure for a bottle containing a carbonated beverage, the closure including:

an inner part adapted to receive a portion of a finish of the bottle, the inner part including a plurality of outwardly extending raised portions; and an outer part adapted to fit substantially over the inner part in an open and a closed position and being movable relative to the inner part between the closed position, in which at least a portion of the outer part urges at least a portion of the inner part against a neck of the bottle to resist disengagement of the inner part from the finish, wherein the portion of the inner part is spaced apart from a top of the bottle, and the open position, in which the portion of the outer part no longer urges at least the portion of the inner part against the neck of the bottle such that the inner part allows disengagement from the finish, wherein the outer part includes a plurality of inwardly extending raised portions, and wherein the outwardly extending raised portions and the inwardly extending raised portions are configured to engage and prevent relative rotation between the inner part and the outer part in the closed position and in the open position; and wherein the plurality of outwardly extending raised portions includes a first plurality of the outwardly extending raised portions and a second plurality of the outwardly extending raised portions, substantially adjacent a top and a bottom of the outer part respectively.

2. A closure as claimed in claim 1, wherein the outwardly extending raised portions are substantially parallel to the inwardly extending raised portions.

3. A closure as claimed in claim 1, wherein the outwardly extending raised portions and the inwardly extending raised portions extend generally longitudinally.

4. A closure as claimed in claim 1, wherein the closure includes an outer surround having a first end releasably connected to the outer part and a second end releasably connected to the neck of the bottle, whereby a connection between the surround and the bottle must be released to allow the outer part to move from the closed position to the open position.

5. A closure as claimed in claim 4, wherein the outer surround is released from the outer part by applying force in a substantially circular or spiral direction.

6. A closure as claimed in claim 4, wherein the surround is a tear strip.

7. A closure as claimed in claim 6, wherein the tear strip is manually tearable.

8. A closure as claimed in claim 6, wherein the tear strip is spirally wound around the neck of the bottle.

9. A closure as claimed in claim 1, wherein said portion of the outer part urges at least said portion of the inner part against the neck of the bottle at a position below a crown bead thereof.

10. A closure as claimed in claim 9, wherein the inner part further includes segments having an inner shape adapted to engage said crown bead of the finish of the bottle.

* * * * *